US005807095A

United States Patent [19]

Gustafson et al.

[11] Patent Number: 5,807,095

[45] Date of Patent: Sep. 15, 1998

[54] PORTABLE FLARE TANK

[75] Inventors: Richard Brian Gustafson; Evert Todd Gustafson; Alfred James Gustafson, all of Calgary, Canada

[73] Assignee: Altex Oilfield Equipment Ltd., Calgary, Canada

[21] Appl. No.: 629,557

[22] Filed: Apr. 9, 1996

Related U.S. Application Data

[63] Continuation-in-part of Ser. No. 556,430, Nov. 9, 1995.

[51] Int. Cl.[6] ..... F23D 14/00

[52] U.S. Cl. ..... 431/202; 95/262; 96/197

[58] Field of Search ..... 220/563, 565, 220/501; 431/202; 95/262; 96/198, 197

[56] References Cited

U.S. PATENT DOCUMENTS

| | | | |
|---|---|---|---|
| 2,243,176 | 5/1941 | Henst . | |
| 2,891,607 | 6/1959 | Webster et al. | 431/202 |
| 3,501,255 | 3/1970 | Greene | 421/202 |
| 3,633,687 | 1/1972 | West et al. . | |
| 3,852,019 | 12/1974 | Stranahan et al. | 431/202 |
| 4,009,985 | 3/1977 | Hirt | 431/202 |
| 4,155,724 | 5/1979 | Burnham | 96/198 |
| 4,397,659 | 8/1983 | Gowan et al. | 95/262 |
| 4,416,672 | 11/1983 | Underwood . | |
| 4,789,170 | 12/1988 | Reber | 220/563 |
| 5,141,020 | 8/1992 | Sunderhaus et al. | 137/521 |
| 5,380,195 | 1/1995 | Reid et al. . | |
| 5,429,496 | 7/1995 | Stephens et al. . | |
| 5,460,285 | 10/1995 | Harding | 220/203.01 |
| 5,507,858 | 4/1996 | Jepson | 95/262 |

FOREIGN PATENT DOCUMENTS

| | | |
|---|---|---|
| 0 211 492 | 2/1987 | European Pat. Off. . |

*Primary Examiner*—Carroll B. Dority
*Attorney, Agent, or Firm*—Burns, Doane, Swecker & Mathis, L.L.P.

[57] ABSTRACT

A flare tank (10) comprises a container (12) having a fluid inlet (14), a fluid outlet (16) and a fluid flow path between the inlet (14) and the outlet (16). A baffle plate (20) is provided in the container (12) between the inlet (14) and the outlet (16). The baffle plate (20) extends transversely relative to the flow path for forming at least a partial barrier to fluid flow in the flow path. A gas outlet, e.g., a chimney stack (18), is located on the container (12) for the discharge of gas separated from the fluid. A burner (46) is provided for the combustion of combustible gas passing through the outlet (18). A holding tank (201) may be provided for holding the fluid following passage through the flare tank (10).

13 Claims, 3 Drawing Sheets

PORTABLE FLARE TANK

CROSS-REFERENCE TO RELATED APPLICATION

This application in a continuation-in-part of application Ser. No. 08/556,430 filed Nov. 9, 1995.

FIELD OF THE INVENTION

This invention relates to a flare tank and, more particularly, to a flare tank used for separating oil from fluid, specifically to separate combustible gases from mud which is produced during a drilling operation in the oil and gas industry.

BACKGROUND OF THE INVENTION

Flares are used in various applications for the disposal of waste gases through combustion. For example, when an oil well is tested, combustible gases may be burned off through the use of a flare tank or stack.

In previous operations, mud from the drill rig which contained combustible gases was piped to or disposed of in a flare pit adjacent to the drill rig. The flare pit is simply a hole dug in the ground which is used to hold the mud. However, the combustible gases can separate from the mud in the flare pit and accidentally ignite thereby causing emissions to the atmosphere which are environmentally unattractive and dangerous to closely located personnel both by way of danger to the person but also due to the possibility of starting a grass or brush fire. Likewise, the mud in the flare pit and the combustible gas can create ground contamination which is also of concern for environmental reasons. Finally, it is necessary to often haul away the mud within the flare pit due to the contamination by unburned gases. This is costly.

It is an object of the present invention to provide a flare tank which facilities separation of the combustible gases from the fluid being treated for gas disposal. It is a further object of the invention to provide a flare tank which is portable so as to minimize disturbances on work sites.

SUMMARY OF THE INVENTION

According to the invention there is provided a flare tank comprising a container having a fluid inlet, a fluid outlet and a fluid flow path between said inlet and said outlet; a baffle plate in the container between said fluid inlet and said fluid outlet, said baffle plate projecting into said flow path of said fluid for forming at least a partial barrier to fluid flow in said path, a gas outlet on said container for the discharge of gas separated from said fluid in said container, and a holding tank associated with said flare tank and being operably connected to said flare tank.

A burner is conveniently used to ignite the separated gas in order to burn it off following its separation from the fluid in the flare tank.

The baffle place may extend substantially transversely across the flow path, the baffle plate being provided with a recess at a lower end thereof for the flow of fluid therethrough.

The baffle plate may be provided with at least one opening above the recess for the passage of gas therethrough. Preferably, a plurality of openings is provided above the recess in the baffle plate.

The gas outlet in the container may comprise a chimney stack on the container. The chimney stack may be pivotally connected to the container for collapsing the chimney stack onto the container to facilitate transportation of the flare tank. The burner may be located at the top end of the chimney stack.

The container may be mounted on a pair of skids to facilitate movement of the flare tank into a desired location.

The flare tank may conveniently be mounted to a holding tank to facilitate the holding and disposal of the mud or fluid following the gas removal in the flare tank.

Further objects and advantages of the invention will become apparent from the description of a preferred embodiment of the invention below.

BRIEF DESCRIPTION OF THE SEVERAL VIEWS OF THE DRAWINGS

Specific embodiments of the invention will now be described, by way of example only, with the use of drawings in which.

DETAILED DESCRIPTION OF PREFERRED EMBODIMENT

Figure 1:
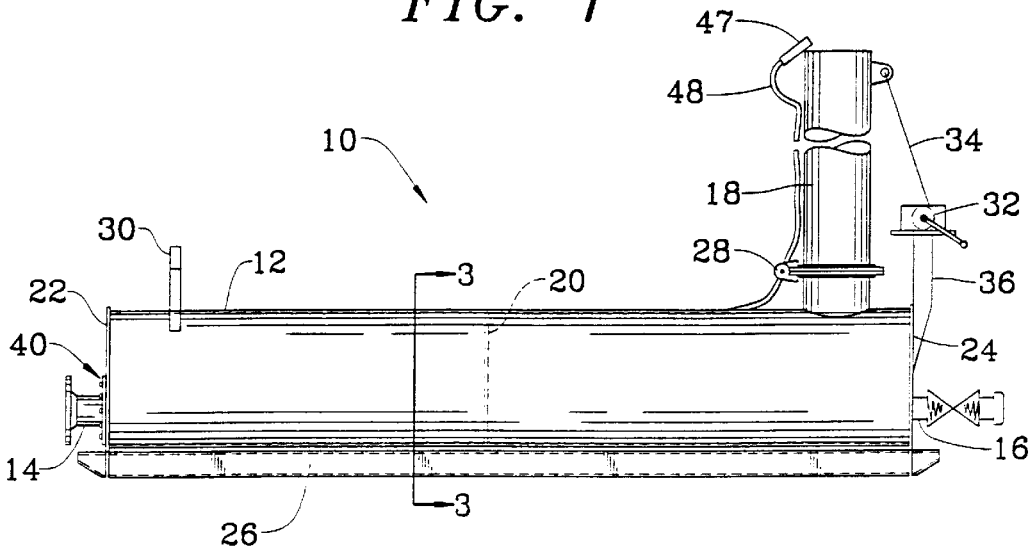
FIG. 1 is a side view of a portable flare tank according to the invention.
Figure 2:
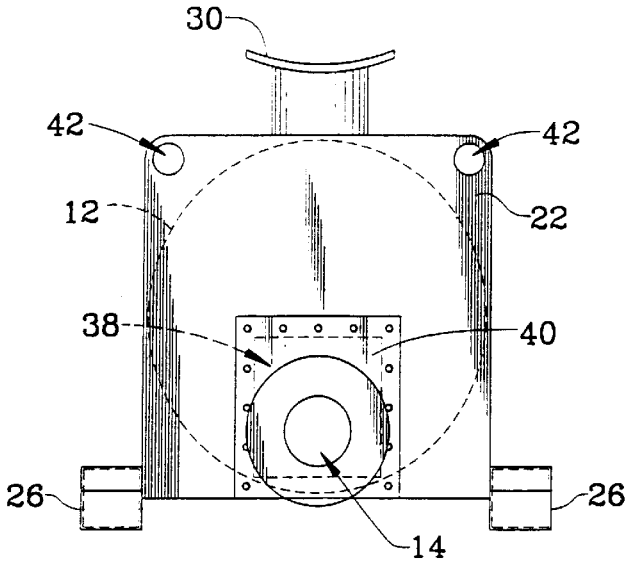
FIG. 2 is an end view of the flare tank of FIG. 1.

In the drawings reference numeral 10 generally indicates a flare tank comprising a cylindrical container 12 having an inlet 14 and an outlet 16, a chimney stack 18, located at the outlet end of the container 12, and a baffle plate 20 in the container 12.

The container 12 is conveniently in the form of a 20 inch diameter pipe and approximately 10 feet long. The container 12 is provided with end plates 22 and 24 at its inlet and outlet ends, respectively. A pair of skids 26 is attached between the plates 22 and 24 for supporting the flare tank 10 and to facilitate moving it into position along the ground.

The chimney stack 18 is connected through a pivotal connection 28 to the container 12 so that it can be collapsed into a generally horizontal position on the container 12 for transport purposes. The housing 12 is provided with a saddle 30 at its opposite end for supporting the free end of the chimney stack 18 when in the collapsed position. A winch 32 with a cable 34 is provided for raising and lowering the chimney stack 18. The winch 32 is attached to the end plate 24 by means of a pillar 36, which may be in the form of a length of square tubing.

The end plate 22 is provided with a cutout 38 which is covered by a removable cover plate 40 for inspection purposes. The plates 22, 24 are also provided with holes 42 for lifting purposes. The outlet 16 is provided with a threaded end for receiving a gate valve.

Figure 3:
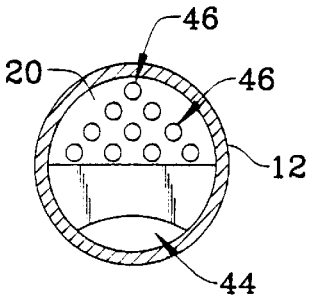
FIG. 3 is a cross section taken along the lines III—III in FIG. 1.

The baffle plate 20 is provided with a recess 44 at its lower end to allow for the passage of fluid therethrough. The baffle plate 20 is further provided with a plurality of holes 46, of about 1¼ inch diameter, and spaced as shown in FIG. 3.

A gas burner 47, which is connectable through a hose 48 to a supply of combustible gas, such as gas in a pressurized cylinder (not shown), is provided. For convenience, a cage (now shown) for holding the gas cylinder can be attached to one side of the container 12.

OPERATION

In use, the flare tank 10 is transported to a desired site, e.g. where an oil well is being drilled. The mud or fluid from the well being drilled contains oil and gas. In order to burn off the gas, the fluid is flowed into the container 12 through the inlet 14, e.g., along a conduit, referred to as the "flare line", extending from the drill string into which the mud from the well is initially introduced.

As the fluid is flowed into the container 12, it impacts upon the baffle plate 20 which causes agitation of the fluid, resulting in separation of the gas, such as H2S, from the fluid. The gas escapes through the openings 46 and passes through the chimney stack 18 where the combustible gas is ignited and burned by the burner 46. The burner 46 is ignited prior to the gases passing through the chimney stack 18.

The flare tank 10 can be used in various different applications, e.g., where it is not desirable to dig a flare pit, such as for environmental considerations, or where it is not possible to dig a flare pit, such as with off shore drilling operations.

Figure 4:
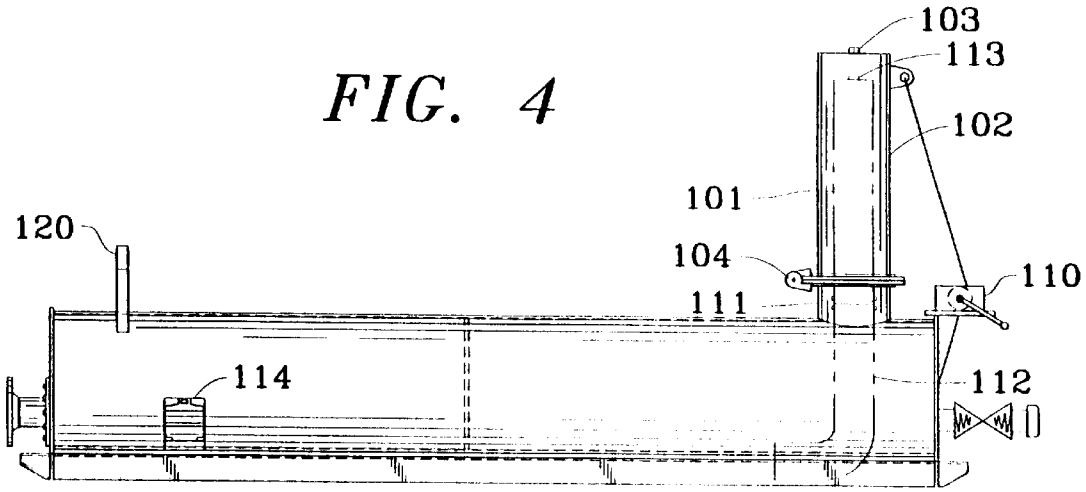
FIG. 4 is a side view similar to that of FIG. 1 but illustrating a second chimney stack.
Figure 5:
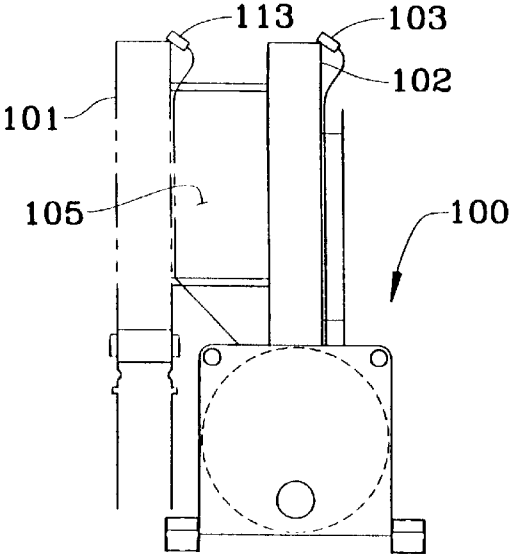
FIG. 5 is an end view of the apparatus illustrated in FIG. 4.

A further embodiment of the invention is illustrated in FIGS. 4 and 5. In this embodiment, the flare tank generally illustrated at 100 has a second chimney stack 101 connected thereto and additional to first chimney stack 102. Chimney stack 102 operates similarly to the chimney stack 18 of the FIG. 1 embodiment; that is, it has a pivoted connection (not shown) and an igniter 103 all as illustrated and described in accordance with the FIG. 1 embodiment.

The second chimney stack 101, however, is additional. It has a pivoted connection 104 and may be raised from the horizontal to the vertical position illustrated using winch 110. The chimney stack 101 has a quick coupler 111 which allows the stack 101 to be connected directly to a pipe 112 which connects with the degasser line (not illustrated) extending from the mud tanks of the drill rig (not illustrated). Second chimney stack 101 has its own igniter 113 and each of the igniters 103,113 is connected to its own respective fuel source, conveniently a propane tank 114. A saddle 120 is provided for holding both of the chimney stacks 101, 102 in their horizontal or transport positions and a mounting bracket 105 is positioned between the two chimney stacks 101, 102 to securely hold the chimney stacks 101, 102 in position.

The operation of the flare tank 100 is similar to that described in connection with the embodiment of FIG. 1. The second chimney stack 101, however, is connected directly to the degasser line (not shown) extending from the mud tanks of the drill rig (not shown). Thus, no fluid enters second chimney stack 101 and no baffle plate is required, the gas being emitted from the chimney stack 101 as the igniter 113 ignites the gases travelling from the outlet of the chimney stack 101.

Figure 6:
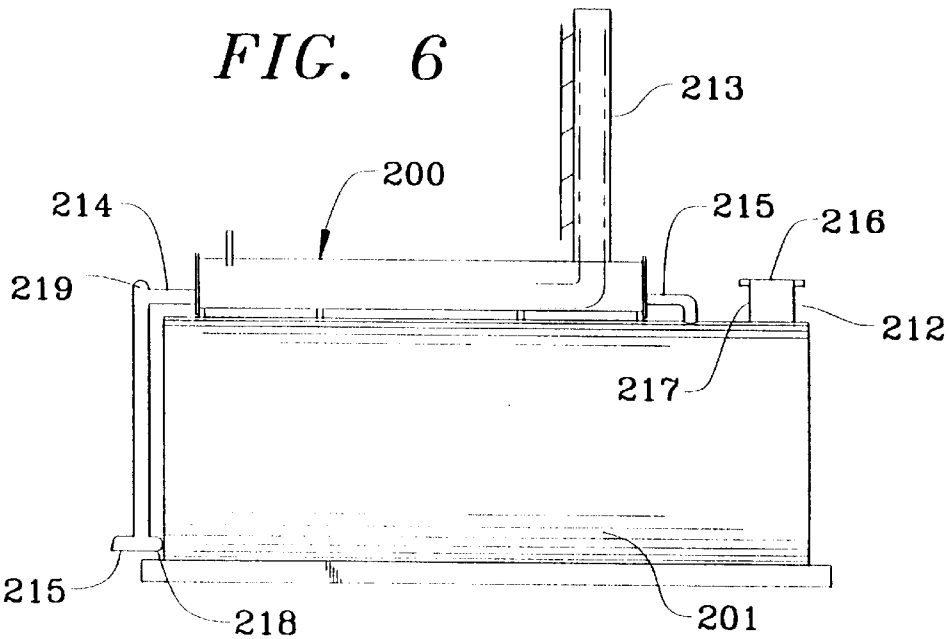
FIG. 6 is a side view of the flare tank according to the invention and mounted on a holding tank.
Figure 7:
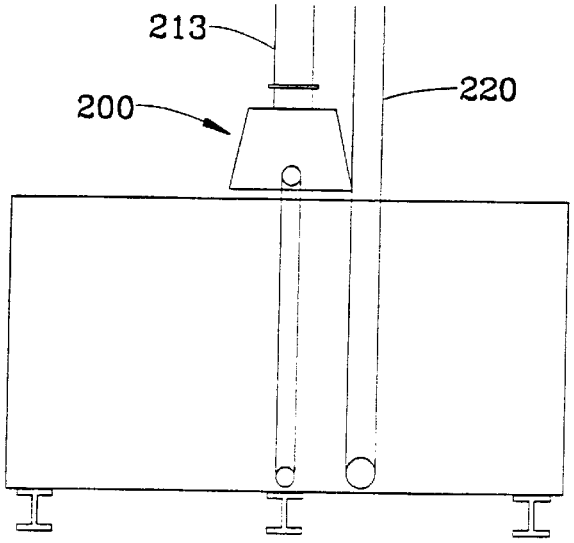
FIG. 7 is an end view of the apparatus illustrated in FIG. 6.
Figure 8:
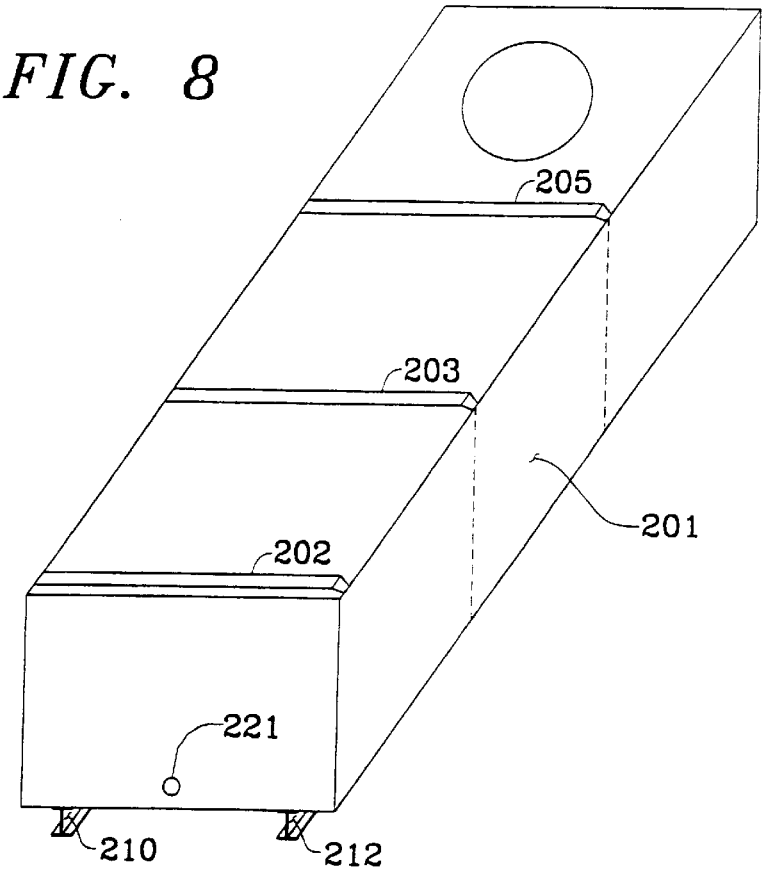
FIG. 8 illustrates the holding tank.

A further embodiment of the invention is illustrated in FIGS. 6 through 8. In this embodiment the flare tank 200 is mounted on a holding tank 201 (FIG. 6), conveniently a tank having a capacity of approximately 2100 gallons. The flare tank 200 sits on three channels 202, 203, 204 as best seen in FIG. 8, which channels are mounted to the top of the holding tank 201 as by welding. The holding tank 201 itself is mounted to I-beam skids 210, 211 which assists in the movement and placement of the apparatus.

The holding tank 201 has an explosion hatch vent 212 protruding vertically from one end of the holding tank 201. In the event of an explosion within the holding tank 201, the vent 212 will allow pressure dispersal without destroying the holding tank 201. The vent 212 has a cap 216 that is mounted above the entranceway pipe 217 and thereby provides venting to the tank 201.

A chimney stack 213 extends vertically from the flare tank 200 and operates identically to the chimney stack 102 of the FIG. 5 embodiment; that is, the gases separated from the fluid in the flare tank 200 will flow out the stack 213 and an igniter (not shown) is mounted on the end of the flare stack 213 to ignite the combustible gases.

In operation, the inlet line 214 will allow the flow of mud through the flare line 215 to the flare tank 200 from the drill string. Lead is provided in the flare line 215 and inlet line 214 at locations 218, 219. This allows the fluid to impact on the lead and rise upwardly therefrom rather than impacting on the elbows of the line and thereby wearing out the elbows prematurely. The fluid will enter the flare tank 200 and move therethrough contacting the baffle plate (not shown) mounted therein where separation of the gases from the fluid will occur in a way similar to the FIG. 5 embodiment. The gases will flow up the chimney stack 213 and will be ignited by the igniter where they will be burned off. The fluid or mud will move past the baffle plate to the outlet 215 (FIG. 6) of the flare tank 200 where the mud will then enter the holding tank 201 for future disposal of the now relatively benign fluid. Alternatively, the outlet 215 may flow into the hatch vent 212 through cap 216.

A second stack 220 (FIG. 7) may likewise be used in this embodiment. The second stack 220 is similar to stack 101 in the FIG. 5 embodiment; that is, the second stack 220 will be used with a quick connect coupler (not shown) which will take gas directly from the degasser line extending from the mud tanks of the drill rig and similarly burn the combustible gases by the use of an igniter.

Holding tank 201 has a fitting 221 (FIG. 8) to allow emptying the holding tank 201 when desired by the operator.

Many modifications will readily occur to those skilled in the art to which the invention relates and the specific embodiments described should be taken as illustrative of the invention only and not as limiting its scope as defined in accordance with the accompanying claims.

What is claimed is:

1. An apparatus for separating combustible gas from fluid produced during a drilling operation, comprising:

a holding tank having an upper surface, said holding tank being provided with a fluid inlet and an explosion vent hatch for permitting pressure dispersal from within the holding tank;

a flare tank mounted on the upper surface of the holding tank for separating fluid from combustible gas, the flare tank having an interior and possessing a longitudinal axis, the flare tank being provided with a fluid inlet for introducing fluid containing combustible gas into the interior of the flare tank, a fluid outlet for discharging out of the flare tank fluid from which the combustible gas has been at least partially removed, and a flow path extending between the fluid inlet and the fluid outlet, the fluid outlet of the flare tank being fluidly connected to the inlet of the holding tank so that fluid from which the combustible gas has been at least partially removed in the flare tank flows into the holding tank, the flare tank including a baffle plate disposed in the interior of the flare tank between the fluid inlet and the fluid outlet, the baffle plate being spaced from the fluid inlet, said baffle plate being positioned generally perpendicular to the longitudinal axis of the flare tank and projecting into said flow path to form at least a partial barrier to fluid flowing from the fluid inlet to the fluid outlet along the flow path so that the fluid impacts upon the baffle plate to facilitate separation of combustible gas from the fluid, said baffle plate being provided with a plurality of openings through which flows combustible gas that has been separated from the fluid;

gas discharge means provided on the flare tank in communication with the interior of the flare tank for discharging from the interior of the flare tank the combustible gas that has been separated from the fluid; and a burner positioned adjacent an outlet of the gas discharge means for igniting the combustible gas discharged through the gas discharge means.

2. The apparatus according to claim 1, wherein said flare tank is an elongated horizontally oriented container.

3. The apparatus according to claim 1, wherein said baffle plate is provided with a recess positioned below said plurality of openings for permitting the flow of fluid past the baffle plate and towards the fluid outlet.

4. The apparatus according to claim 3, wherein said recess is located in a lower portion of said baffle plate.

5. The apparatus according to claim 1, wherein said gas discharge means is a chimney stack mounted on the flare tank.

6. The apparatus according to claim 5, wherein said chimney stack is pivotally connected to said container for collapsing the chimney stack into a horizontal position onto said container to facilitate transportation of the flare tank.

7. The apparatus according to claim 5, wherein said chimney stack has a top end positioned remote from the flare tank, said burner being located at a top end of the chimney stack.

8. The apparatus according to claim 1, wherein said holding tank is mounted on skids to facilitate movement of the apparatus to a desired location.

9. The apparatus according to claim 5, wherein said chimney stack is a first chimney stack, and further comprising a second chimney stack for the combustion of gas from a well and a second burner to ignite gas passing through said second chimney stack.

10. An apparatus for separating combustible gas from fluid produced during a drilling operation, comprising:

a holding tank;

a flare tank operably connected to the holding tank for separating fluid from combustible gas, the flare tank having a fluid inlet for introducing fluid containing combustible gas into the interior of the flare tank, a fluid outlet for discharging out of the flare tank fluid from which the combustible gas has been at least partially removed, and a flow path extending between the fluid inlet and the fluid outlet, the flare tank including a baffle plate disposed in the interior of the flare tank between the fluid inlet and the fluid outlet, said baffle plate projecting into said flow path to form at least a partial barrier to fluid flowing from the fluid inlet to the fluid outlet along the flow path, and a chimney stack provided on the flare tank, said chimney stack being pivotally mounted on the flare tank for collapsing the flare tank into a horizontal position onto the flare tank.

11. The apparatus according to claim 10, including a burner positioned adjacent an outlet of the chimney stack for igniting the combustible gas discharged through the chimney stack.

12. The apparatus according to claim 11, wherein said chimney stack is a first chimney stack and said burner is a first burner, and including a second chimney stack mounted on the flare tank for discharging combustible gas and a second burner for igniting combustible gas passing through said second chimney stack.

13. A method of separating combustible gas from fluid obtained during a drilling operation and subsequently discharging the combustible gas, comprising:

introducing fluid from a drilling operation that contains combustible gas into a fluid inlet located at a lower portion of a flare tank, the flare tank having an interior and a longitudinal extent and being provided with a fluid outlet, said flare tank being mounted on top of a holding tank;

flowing the fluid through the interior of the flare tank along a flow path;

separating combustible gas from the fluid by impacting the fluid against a baffle plate that is perpendicularly disposed within the interior of the flare tank between the fluid inlet and the fluid outlet so that the baffle plate projects into the flow path for forming at least a partial barrier to fluid flowing from the fluid inlet to the fluid outlet along the flow path, the entire baffle plate being spaced from the fluid inlet so that fluid enters the interior of the flare tank and flows along a portion of the interior of the flare tank before impacting the baffle plate, the baffle plate including a plurality of openings through which passes the combustible gas that has been separated from the fluid;

discharging, through the fluid outlet of the flare tank, fluid from which combustible gas has been separated and directing the fluid discharged through the fluid outlet into the holding tank;

discharging combustible gas that has been separated from the fluid out of the interior of the flare tank and into a chimney stack mounted on the flare tank; and igniting the combustible gas discharged through the chimney stack by way of a burner positioned adjacent an open end of the chimney stack.

* * * * *